United States Patent [19]

Lipes

[11] 4,253,292

[45] Mar. 3, 1981

[54] AUTOMATIC WEIGHING AND BAGGING MACHINE

[76] Inventor: Arnold Lipes, 6521 Merton Rd., Cote St. Luc, Quebec, Canada

[21] Appl. No.: 47,697

[22] Filed: Jun. 12, 1979

Related U.S. Application Data

[63] Continuation-in-part of Ser. No. 852,678, Nov. 18, 1977, Pat. No. 4,172,349.

[51] Int. Cl.[3] ..... B65B 1/32; B65B 43/30

[52] U.S. Cl. ..... 53/502; 53/506; 53/572; 53/384; 53/385; 177/118

[58] Field of Search ..... 53/459, 572, 502, 506, 53/570, 571, 384, 385; 141/83; 177/118, 160, 56, 59, 114, 106

[56] References Cited

U.S. PATENT DOCUMENTS

| | | | |
|---|---|---|---|
| 3,521,426 | 7/1970 | Evins | 53/502 |
| 3,695,371 | 10/1972 | Sheetz | 177/59 |
| 3,789,570 | 2/1974 | Mullins | 53/459 |
| 3,822,527 | 7/1974 | Germunson et al. | 53/572 |
| 3,864,894 | 2/1975 | Sheetz et al. | 53/506 |
| 4,172,349 | 10/1979 | Lipes | 53/459 |

*Primary Examiner*—Travis S. McGehee

*Attorney, Agent, or Firm*—Guy J. Houle; Alan Swabey; Robert E. Mitchell

[57] ABSTRACT

An automatic weighing and bagging machine and method for holding and opening a first bag of a plurality of juxtaposed bags held in the machine in a manner whereby the first bag may be filled with a weighed product and released from the plurality of bags. The bags are of the type having an extended tab secured to a portion thereof and extending above a mouth opening of the bag. The machine comprises a holding device for engaging at least a portion of the extended tab of the first bag. A retractor member is also provided for opening the mouth opening of the first bag by pulling a side wall portion of the first bag opposite to the engaged portion of the tab and away from the engaged tab. The retractor member also clamps the side wall portion to hold the bag in an open position whereby the bag is held from opposed sides for filling the bag with the weighed product. A container is provided to hold and weigh the product to be bagged. A discharge mechanism displaces the weighed product from the container to the open mouth of the first bag to place the product therein. A sensor to detect the delivery of the weighed product to the first bag is provided. An actuating system is also provided for releasing the holding means and clamping means to cause the first bag with the weighed product to be released.

19 Claims, 7 Drawing Figures

AUTOMATIC WEIGHING AND BAGGING MACHINE

This invention is a continuation-in-part of my patent application Ser. No. 852,678 filed on Nov. 18, 1977, now U.S. Pat. No. 4,172,349.

BACKGROUND OF INVENTION (a) Field of the Invention

The present invention relates to an automatic weighing and bagging machine and the method of operation thereof, and more particularly, to a machine capable of weighing a product and inserting it into an open mouth of a first bag of a plurality of bags and releasing the filled bag.

(b) Description of the Prior Art

Bagging machines for holding, transporting, filling and sealing plastic bags are well known such as disclosed in applicant's own U.S. Pat. No. 3,946,538 issued on Mar. 30, 1976 and other prior art, for example, U.S. Pat. No. 3,731,454 issued to Ag-Pak Inc. on May 8, 1973. Such prior art is of the type where a first bag of a plurality of juxtaposed bags is engaged by clamping means and transported by the clamping means for filling and sealing the bag. Such prior art devices are fairly complex in construction due to the various clamping arms required to be activated and the displacement of the clamping mechanisms.

There exists the need for a simple, uncomplicated automatic weighing and bagging machine where a product to be bagged is weighed and delivered automatically to an open bag and then released for transportation by other means to a bag closing station.

SUMMARY OF INVENTION

It is a feature of the present invention to provide an automatic weighing and bagging machine which will supply this need.

According to a further feature of the present invention, there is provided an automatic weighing and bagging machine which is capable of holding a first bag of a plurality of juxtaposed bags in an open position before displacing said first bag from its juxtaposed position whereby the bag is filled with a weighed product and detached before releasing it so that the bag can be filled with light products and does not depend on its weight to detach itself from the means holding it juxtaposed.

It is a further feature of the present invention to provide an automatic weighing and bagging machine having a weighing bucket where a predetermined quantity of product weight is determined and the weighed product is directed to an open mouth of a bag and sensing the delivery of the product to initiate a second weighing operation.

A further feature of the present invention is to provide a method of weighing and bagging the weighed product in an open first bag of a plurality of juxtaposed bags to permit filling the first bag in its juxtaposed position and releasing the first filled bag so that the bag will be released from its juxtaposed position and fall by gravity.

According to the above features, from a broad aspect, the present invention provides an automatic weighing and bagging machine for placing a weighed product in a first bag of a plurality of juxtaposed bags held in said machine, said bags each having an extended tab secured to a portion thereof, said tab extending above a mouth opening of said bag, said machine comprising retaining means for supporting said plurality of bags in juxtaposition, holding means for engaging at least a portion of said extended tab of said first bag, bag opening means for opening said mouth opening of said first bag by pulling a side wall portion of said first bag, opposite to said engaged portion of said tab, away from said engaged tab, clamping means associated with said bag opening means for clamping said side wall portion to hold said bag in an open position whereby said bag is held from opposed sides, container weighing means for holding and weighing a product to be bagged, discharge means for displacing said weighed product from said container weighing means to said open mouth of said first bag to place said weighed product in said first bag, sensing means to detect the delivery of said weighed product to said first bag, and actuating means for releasing said holding means and clamping means to cause said first bag with said weighed product to be released from said machine due to its own weight.

According to a further broad aspect of the present invention, there is provided a method of weighing and bagging a product in a first bag of a plurality of juxtaposed bags, each said bag having a tab extending above a mouth opening of said bag, said method comprising the steps of: (i) retaining a plurality of said bags in juxtaposition by retaining means, (ii) engaging a portion of said extended tab of said first bag while maintaining said first bag juxtaposed with said plurality of bags, (iii) opening and pulling a side wall portion of said first bag, opposite to said engaged portion of said tab, away from said engaged tab and clamping said side wall portion to hold said bag from opposed sides, (iv) placing a predetermined quantity of said product in a weigh bucket, (v) tipping said bucket to discharge said weighed product in the mouth opening of said first bag, (vi) sensing the discharge of said weighed product, and (vii) releasing said engaging portion of said extended tab prior to releasing said bag filled with said weighed product.

BRIEF DESCRIPTION OF DRAWINGS

A preferred embodiment of the present invention will now be described with reference to the accompanying drawings in which.

DESCRIPTION OF PREFERRED EMBODIMENTS

Figures 1, 6:
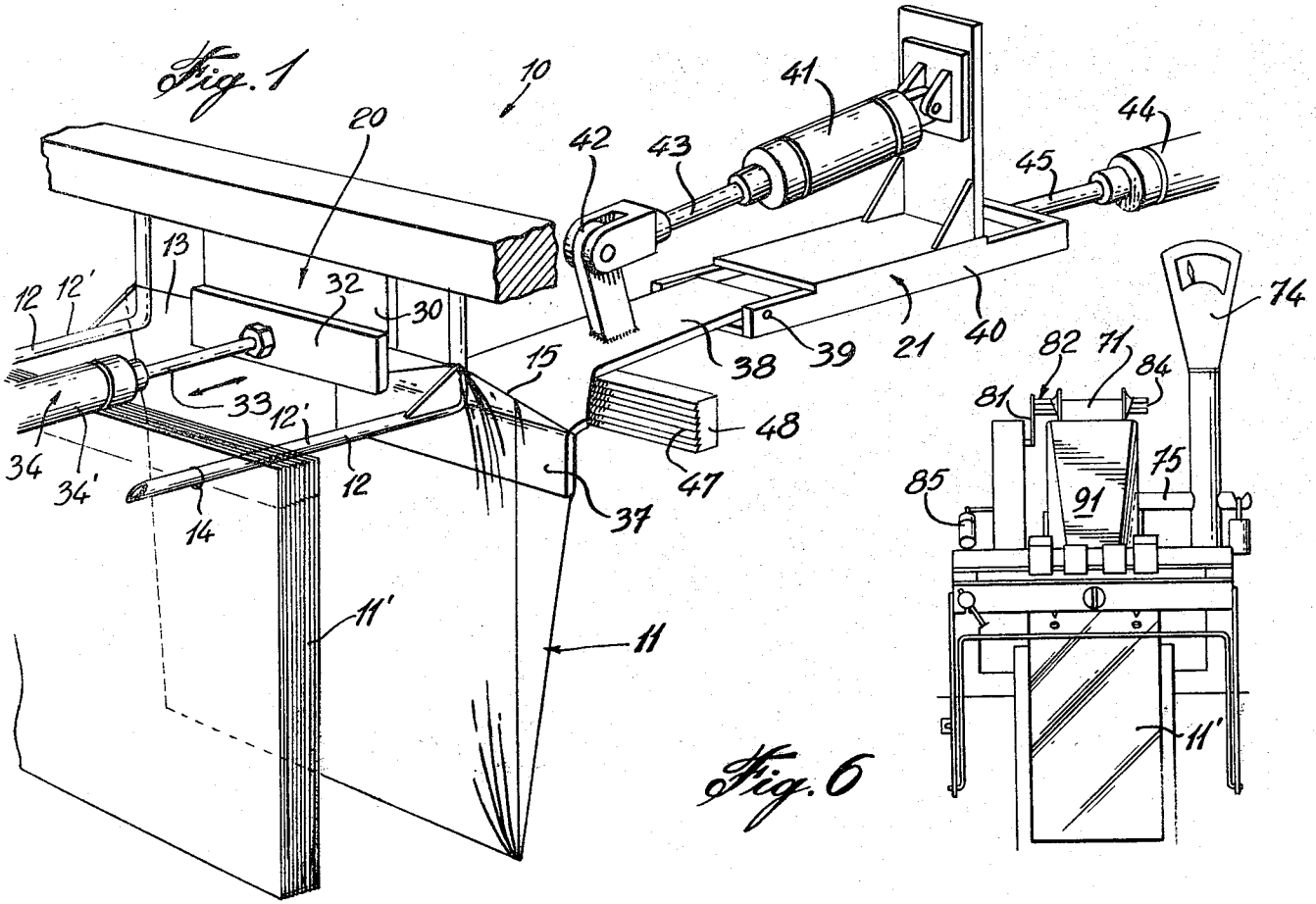
FIG. 1 is a perspective view, partly fragmented, illustrating an example of the essential parts of the bagging machine to be used in combination with a weighing container of the present invention.
FIG. 6 (which appears on the sheet with FIG. 1) is a front view of FIG. 5.

Referring now to the drawings, there is shown generally at 10, the essential parts of the automatic bagging machine for holding and opening a first bag 11 of a plurality of juxtaposed bags 11' held in the machine by wicket pins 12. Each of the bags 11 has an extended tab 13 provided with two spaced apart holes 14 therein whereby the bags are slidingly retained on the wicket pins 12. Each bag is also provided with a mouth opening 15 defined between a bag rear wall 16 and a bag front wall 17, see FIG. 2.

The machine comprises generally holding means 20 for engaging at least a portion of the extended tab 13 of a first bag 11, a bag opening means 21 for opening the mouth opening 15 of the first bag by pulling a side wall portion, herein the front wall 17, of the first bag away from the engaged tab 13, and actuating means 22 for causing the holding means 20 and clamping means 23, associated with the bag opening means 21, to release the first bag 11.

The holding means 20 is constituted by a stationary clamp 30 having a clamping surface 31 positioned in front of the extended tab 13 of the first bag 11. A displaceable clamp 32 is secured to the free end of a piston rod 33 of piston 34. The clamping surface 35 of the displaceable clamp 32 is positioned in alignment with the clamping surface 31 of the stationary clamp 30 whereby all of the extended flaps 13 are held compressed between the clamping surfaces 31 and 35 when the piston rod 33 is displaced outwardly from the piston cylinder 34'.

The bag opening means 21 comprises an air jet 36 which is positioned adjacent the mouth opening 15 of the bag whereby to direct a jet of air in the mouth opening after the extended tab 13 is engaged by the holding means 20 whereby to cause the bag to open and to permit the insert end portion 37 of a retractor member 38 to be positioned within the opening 15.

The retractor member 38 is hinged at 39 to a movable frame 40 and is displaceable arcuately in an up and down direction on the hinge connection 39 by a piston 41 mounted at a downward angle with respect to the frame 40 and having its rod end 42 secured to the retractor member 38. By extending the piston rod 43, in and out of the cylinder 41' of piston 41, the retractor member will be displaced in an arcuate up and down manner.

A further piston 44 is secured to the movable frame 40 whereby to displace the frame 40 towards and away from the first bag of the plurality of bags 11'. During a first stroke, the piston rod 43 is in a retracted position and the piston 44 is extended towards the first bag 11. During the second stroke, the piston 41 is actuated to extend the piston rod 43 and simultaneously the piston 44 retracts its piston rod 45 whereby the insert end portion 37 goes into the mouth opening and pulls the front wall 17 away from the rear wall 16 until a top portion of the front wall 17 is clamped between a clamping surface 46 of the insert end portion 37 and a clamping surface 47 of a stationary clamp 48. As the front wall 17 is pulled away from the rear wall 16, the extended tab 13 will disconnect from the wicket pins 12, as shown at 13' in FIGS. 3 and 4. To facilitate disconnection, a razor edge 12' is provided along the top of the pins 12. Such disconnection is desirable when bagging very light products. However, the disconnection can be effected by the weight of the product inserted into the bag at either the insertion stage or the bag release stage of the cycle.

Figure 3:
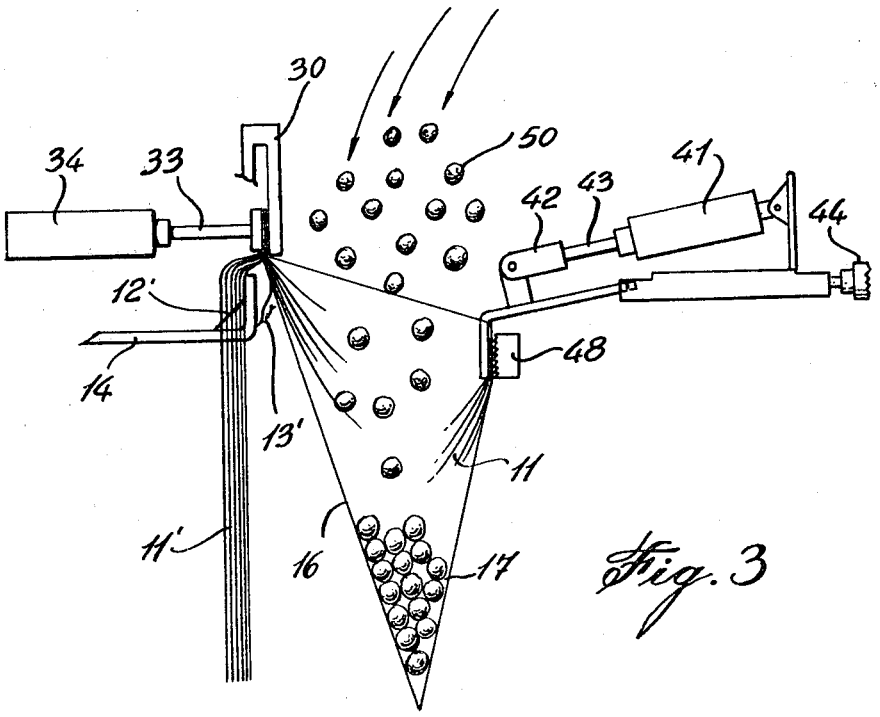
FIG. 3 is a further schematic view illustrating a further step in the operation of the bagging machine where a weighed product is inserted into a first open bag.
Figures 4, 5:
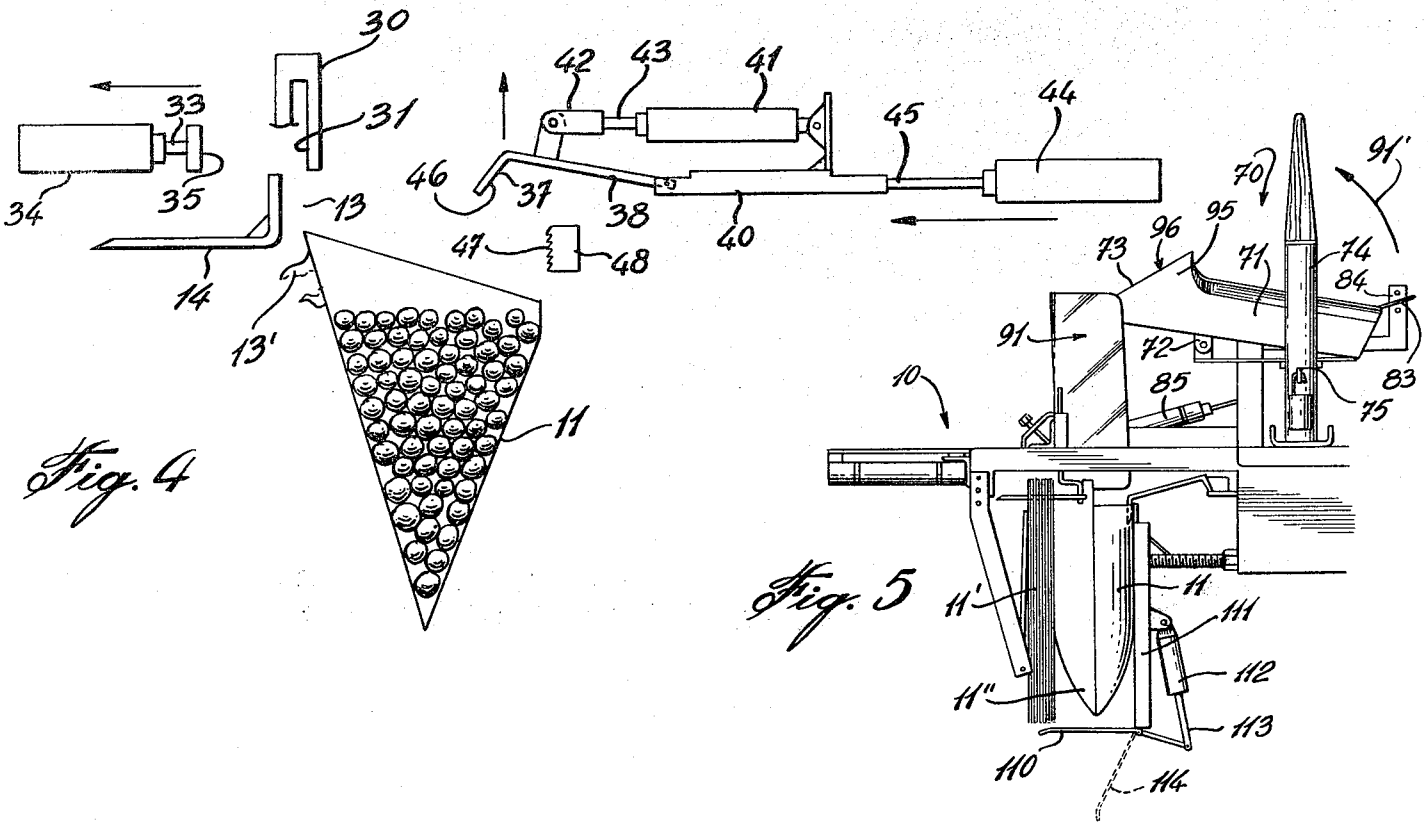
FIG. 4 is a still further schematic view illustrating a further step in the operation where the filled bag is released.
FIG. 5 is a side view showing the weighing and bagging machine combination.

As shown in FIG. 3, when the extended tab 13 is clamped as well as a portion of the front wall 17, the bag 11 is held from opposite sides and ready to receive a product 50 therein. While the insert end portion 37 was pulling the front wall 17 of the bag 11, the extended tab 13 ripped itself free from the wicket pins 12, as mentioned above. After a predetermined quantity or weight of the product 50 is inserted within the bag 11, the pistons 34, 41, and 44 are again activated to perform a release stroke, as shown in FIG. 4, with the piston 34 retracting its piston rod and, therefore, releasing the extended tab 13 and simultaneously the piston 41 retracting its piston rod thereby causing the retractor member to move upwardly with a simultaneous operation of piston 44 causing its piston rod 45 to move outwardly to cause release of the engaged top portion of the front wall 17 of the bag 11. Thus, the bag is free to fall by gravity, no matter how light its content.

Figure 2:
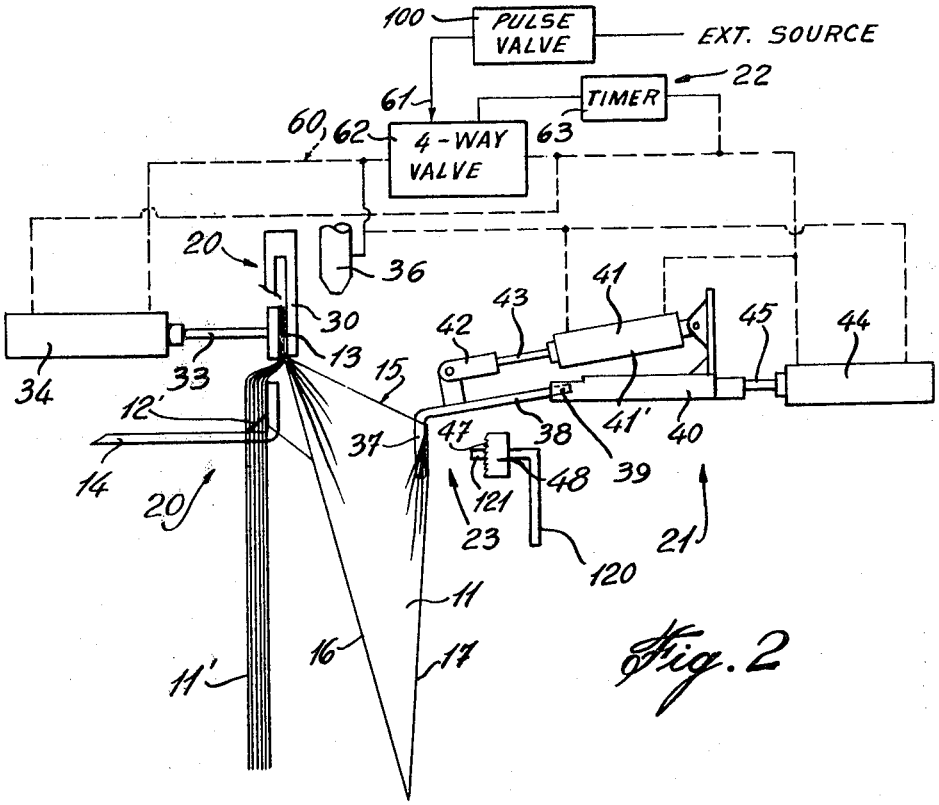
FIG. 2 is a schematic view illustrating the operation of the bagging machine of the present invention during opening of a bag.

The pneumatic system for operating the pistons is schematically illustrated at 60. The system comprises an external source of pressure (not shown) connected to an input 61 of a four-way valve 62 (main pneumatic valve). All of the pistons are two-stroke (double-acting) pistons and in one stroke of the operation, as illustrated in FIGS. 2 and 3, piston 34 moves against the extended tabs 13 to apply pressure to retain the first bag 11. Previously, the air jet 36 was activated whereby to cause the front wall 17 of the first bag 11 to move away from the rear wall 16. While the piston 34 clamps the tabs 13, the cylinder 41 is activated, causing the insert end portion 37 of the retractor member 38 to move within the mouth opening while piston 44 is activated to pull back the movable frame 40 to a position where the clamping surface 46 of the insert 37 clamps a top portion of the front wall 17 of the bag 11 between it and a clamping surface 47 of the stationary clamp 48. Thus, the bag is now positively held from opposed sides and ready to receive a weighed product 50 therein. The weighing mechanism and delivery of the weighed product will be described later. A timer 63 is connected in the circuit to provide a suitable time delay for the blowing open the bag 11 prior to activating the second cycle of the pneumatic system.

FIG. 4 illustrates a second cycle of operation of the system wherein the piston 34 is activated in the opposed direction to cause retraction of its piston rod to release the extended tab 13. Simultaneously, the piston 44 is activated to move its piston rod 45 outwardly whilst the piston 41 is activated to retract its piston rod simultaneously causing the retractor member 38 to move upwardly and forwardly as indicated by the arrows. This will release all engagement with the bag 11 which will rip itself from the wicket pins 14, if not already detached, and fall by gravity on conveying means (not shown) positioned below the bag 11.

Figure 7:
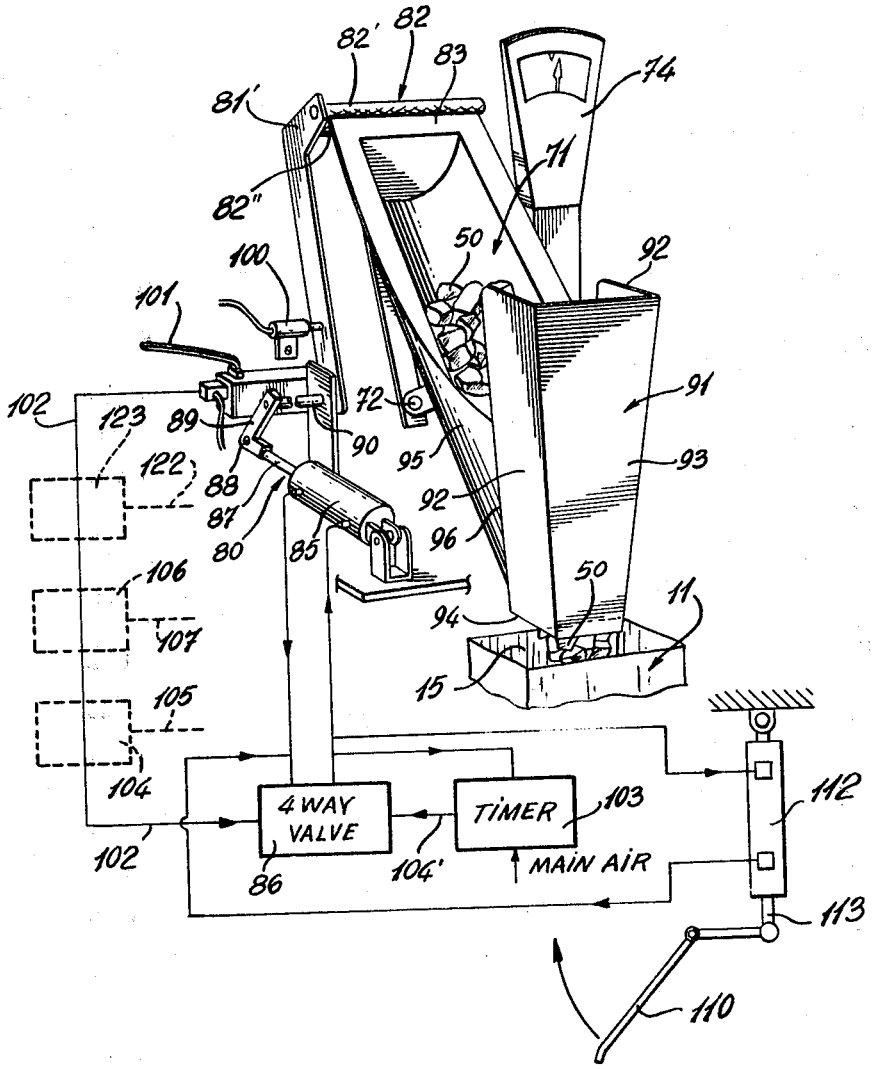
FIG. 7 is a composite perspective view of the weighing bucket assembly and schematic illustration of the pneumatic circuit and support platform.

Referring now to FIGS. 5, 6 and 7, there is shown the weighing mechanism associated with the bagging machine 10. The weighing mechanism is generally indicated by reference numeral 70 and comprises a container weighing means 71 for holding and weighing the product 50 to be bagged. The weighing mechanism 70 comprises a container weighing means, herein a weigh bucket 71, having a pivotal attachment 72 whereby the bucket 71 may be tipped forwardly to release product through a discharge mount 73 thereof. A weigh scale 74 is coupled to the weigh bucket 71 through a balance arm 75 whereby the product in the bucket 71 may be weighed.

In order to discharge the product from the bucket 71, there is provided a discharge means in the form of a tipping mechanism 80 which comprises a piston activated linkage including a tipping arm 81 having a bucket engaging means 82 to releasably engage with the bucket 71 to cause the bucket pivotal displacement and adapt it to release the bucket (not being in engagement therewith), during the weighing operation not to affect the weight of the product being weighed.

The bucket engaging means constituted a releasably engageable guide member to displace an engageable element, herein a rear flange 83 of the bucket 71, in an arcuate path about the pivotal attachment 72. As the bucket 71 is pivoted, the product 50 therein will slide out of the discharge mouth 73 in the front portion of the bucket. The bucket engaging means 82 is herein constituted by two spaced apart fingers 82' and 82'' which define a gap 84 therebetween with the rear flange 83 extending in the gap intermediate the spaced apart fingers 82' and 82'' when the bucket is in a weighing position, as shown in FIG. 5. The fingers 82' and 82'' are secured to the top end 81' of the tipping arm 81 which is arcuately displaced from a bucket weighing position, as shown in FIG. 1, to a bucket discharging position, as shown in FIG. 7, by a tipping air cylinder 85. The cylinder 85 is operable through a control valve means, herein the four-way control valve 86.

The tipping air cylinder 85 has a cylinder rod 87 having its rod end 88 connected to a link arm 89 which is connected through pivot 90 to the tipping arm 81. With the piston rod 87 fully extended, as shown in FIG. 7, the tipping arm 81 is displaced arcuately upwards in the direction of arrow 91 to place the bucket 71 in its discharge position. When the piston rod 87 is retracted, the tipping arm 81 is positioned substantially horizontally, as shown in FIG. 5, and the bucket is in its weighing position.

In order to direct the weighed product 50 in the open mouth 15 of a first bag 11 of the plurality of juxtaposed bags, there is provided a guide funnel 91 secured forwardly of the bucket 71 and above the mouth opening 15 of the first bag 11. The funnel 91 has a downwardly tapering U-shaped cross-section having an open side wall, facing the bucket 71, opposed side end walls 92, a rear wall 93, and an open bottom end 94. The bucket 71 is formed with a guide flange 95 on opposed sides of its discharge mouth 73. Each guide flange tapers forwardly at a top edge 96 whereby the top edge will be aligned with the edge of the opposed side end walls of the funnel 91 when the bucket 71 is in its discharge position as shown in FIG. 7. Thus, the guide flange 95 in combination with the guide funnel 91 constitutes a funnel with a closed side wall whereby all of the weighed product 50 will be confined and directed to the open bottom end 94 of the funnel to be discharged in the open end 15 of the bag 11.

Referring now to FIGS. 7 and 2, there is shown a sensing means, herein a position sensing switch constituted by a pulse valve 100 to detect the delivery of the weighed product 50 to the first bag 11. The pulse valve 100 is secured to the machine frame at a position where is tipping arm 81 will reset the valve when the bucket 71 is in its discharge position. As shown in FIG. 2, the pulse valve 100 is connected to the main pneumatic four-way valve 62 of the actuating means of the bagging machine to cause the bagging machine to go through a complete bag opening cycle when the pulse valve is released from engagement by the tipping arm 81, that is, when the bucket is returned to its weighing position. Thus, when the bucket is in its weighing position, the first bag 11 is opened to await the discharge of the weighed articles therein and the next bag opening cycle will be disabled until the product has been released in the bag and the bucket is returned to its weighing position.

In order to cause activation of the tipping mechanism to place the bucket in its discharge position, as shown in FIG. 7, there is provided a discharge switch valve 101 which may be manually operated or automatically operated by a weight sensing device (not shown) associated with the weigh scale 74. The discharge switch 101 is connected to the control valve 86 via air line 102. A timer 103 is also connected to an input connection 104 of the control valve 86 to hold the bucket 71 at its discharge position for a predetermined period of time before it permits the control valve 86 to return the bucket 71 to its loading or weighing position.

A first shut-off valve 104 may be connected in the air line 102 to prevent the discharge switch 101 to signal the control valve 86 if the weight of the product in the bucket 71 is under a desired value. This first shut-off valve would receive a signal at its input 105 from a weight sensing device (not shown) associated with the weigh scale 74. A second shut-off valve 106 may also be connected in the air line 102 to stop the operation of the bucket tipping mechanism when a main conveyor (not shown) of the bagging machine is stopped whereby bagged products are not delivered one on top of the other. The second shut-off valve could also be operated if it is necessary to release a filled bag at a delayed moment to prevent releasing bags one on top of the other. Thus, a sensor (not shown) would detect the presence of a bag already on a main conveyor (not shown) and positioned under the filled bag. Such sensor would be connected to the input connection 107.

As shown in FIGS. 5 and 7, a bag support platform 110 may be displaceably connected under the first bag 11 to a frame 111. The platform 110 is provided to support a bottom 11'' of the first bag 11 when the weighed product is discharged therein, particularly if the product is heavy, such as when bagging carrots or the like produce or other heavy articles. The platform 110 is activated by a platform cylinder 112 which causes the platform 110 to be displaced under the bag (as shown in solid lines in FIG. 5) when the tipping cylinder 85 of the tipping mechanism is activated to tip the bucket 71. When the piston rod 87 of the cylinder 85 is retracted, the piston rod 113 of the piston 112 is also retracted causing the platform to be retracted to its release position as shown by phantom line 114, in FIG. 5, to release the filled bag 11. FIG. 7 shows the pneumatic connection of the platform cylinder 112 in the pneumatic system.

Referring again to FIGS. 2 and 7, there is shown a first bag sensor element 120 to detect the presence of a first bag 11 in its proper position to receive the weighed product. As herein shown, the sensor 120 is an air jet having a sensing open end 121 extending forwardly of the clamping face 47 whereby a portion of the wall 17 of the bag 11 will be retained thereagainst to cut off the air flow out of the sensor, thereby detecting the proper position of the bag. Other sensing means of electrical or mechanical design may also be provided to serve the same purpose. The sensor 120 is connected to the input 122 of a bag sensing shut-off valve 123 which would be secured in the air line 102. The shut-off valve 123 prevents the discharge switch 101 to signal the control valve 86 in the absence of a first bag 11 at a proper receiving position with the mouth thereof being opened.

Although the automatic weighing mechanism is herein disclosed in combination with my bagging device of my afore-mentioned patent application and slightly modified, it is foreseen that it can also be adapted to other bagging machines provided they are capable of holding an openmouth bag to receive the weighed product from the discharge mouth of the weigh bucket. Also, it is within the ambit of the present invention to provide a method of weighing the product which is fully automated whereby the product may be automatically delivered to the bucket and the delivery rate stopped automatically with the discharge being also effected automatically, as described herein above. The pneumatic system with its shut-off valve adaptations, as disclosed above, would provide all the necessary surveyance and command signals to control the operation of the weighing mechanism in combination with a bagging machine.

Furthermore, the bags are not restricted to those of the type having holes in the tab to be supported on wicket pins. The holding means 20 could be constituted by having further side clamps which could engage the extended tab on opposed sides of the clamps 30 and 32 and work in reverse to the clamps 30 and 32 whereby to hold the juxtaposed bags 11' while the bag is being filled and released. When the clamps 30 and 32 are engaged, the side clamps would be disengaged to permit the portions of the tab extending beyond opposed side edges to the clamps 30 and 32 to bend around these and clear the side clamps. Thus, when the filled bag is released by clamps 30 and 32, the remaining juxtaposed bags are held clamped by the side clamps.

I claim:

1. An automatic weighing and bagging machine for placing a weighed product in a first bag of a plurality of juxtaposed bags held in said machine, said bags each having an extended tab secured to a portion thereof, said tab extending above a mouth opening of said bag, said machine comprising retaining means for supporting said plurality of bags in juxtaposition, bag opening means for opening said mouth opening of said first bag, clamping means associated with said bag opening means for holding said bag in an open position by clamping said bag from opposed sides thereof, a weigh bucket for holding and weighing a product to be bagged, a weigh scale coupled to said weigh bucket for weighing said product to be bagged, discharge means for displacing said weighed product from said container weighing means to said open mouth of said first bag to place said weighed product in said first bag, said discharge means being a tipping mechanism for displacing said bucket on a pivotal attachment for discharging said weighed product therein into said first bag, said tipping mechanism having a piston activated linkage having bucket engaging means releasably engageable with said bucket for causing said bucket pivotal displacement and to release said bucket for weighing said product therein, sensing means to detect the delivery of said weighed product to said first bag, said sensing means being operable by said tipping mechanism when said bucket is displaced to its discharge position to reset said sensing means, said sensing means being a sensing switch connected to a main pneumatic valve of said actuating means to cause said bagging machine to go through a complete bag opening cycle when said switch is released from said tipping mechanism when said bucket is returned to a loading-/weighing position, and actuating means for releasing said holding means and clamping means to cause said first bag with said weighed product to be released from said machine due to its own weight.

2. An automatic weighing and bagging machine as claimed in claim 1 wherein said bucket has an engageable element, said bucket engaging means being a releasably engageable guide member to engage and displace said engageable element in an arcuate path about said pivotal attachment to tip said bucket whereby said product therein will slide out at a discharge end and be directed in said first bag.

3. An automatic weighing and bagging machine as claimed in claim 2 wherein said engageable element is a rear flange of said bucket, said guide member comprising two spaced apart fingers defining a gap therebetween, said rear flange extending in said gap intermediate said spaced apart fingers when said bucket is at a weighing position, said fingers being secured to an arcuate displaceable link arm to tip said bucket.

4. An automatic weighing and bagging machine as claimed in claim 3 wherein said link arm is actuated by a tipping air cylinder operable through a control valve means.

5. An automatic weighing and bagging machine as claimed in claim 3 wherein a guide funnel is secured forwardly of said bucket above said mouth opening of said first bag, said funnel being of downwardly tapering U-shaped cross-section having an open side wall facing said bucket discharge end, opposed side end walls, a rear wall, and an open bottom end.

6. An automatic weighing and bagging machine as claimed in claim 5 wherein said bucket has a guide flange on each opposed side of said discharge end, each guide flange tapering forwardly at a top edge; said bucket, when in a discharge position, said guide flanges being aligned with said funnel opposed side end walls to constitute with said funnel rear wall a closed side wall funnel.

7. An automatic weighing and bagging machine as claimed in claim 1 wherein there is provided a discharge switch, said tipping mechanism being a linkage connected to a piston rod end of a tipping cylinder, said piston rod end being actuable by a control valve, said discharge switch being connected to said control valve to cause said bucket to move to its discharge position.

8. An automatic weighing and bagging machine as claimed in claim 7 wherein a timer is connected to said control valve to hold said bucket at said discharge position for a predetermined period of time before causing displacement of said piston rod end to return said bucket to its loading position.

9. An automatic weighing and bagging machine as claimed in claim 8 wherein said discharge switch is automatically activated by a weight sensing device of said weigh scale.

10. An automatic weighing and bagging machine as claimed in claim 7 wherein said discharge switch is a pneumatic switch having an air line connected to said control valve, a first shut-off valve connected in said air line to prevent said discharge switch to signal said control valve if said weight of said product in said bucket is under a desired value.

11. An automatic weighing and bagging machine as claimed in claim 1 wherein there is further provided a bag support platform displaceable under said first bag to support a bottom of said first bag when said weighed product is discharged therein.

12. An automatic weighing and bagging machine as claimed in claim 11 wherein said support platform is activated by a platform cylinder, said platform cylinder displacing said platform under said first bag when a tipping cylinder of said tipping mechanism is activated to tip said bucket.

13. An automatic weighing and bagging machine as claimed in claim 10 wherein a second shut-off valve is connected in said air line to stop the operation of said bucket tipping mechanism when a main conveyor of said bagging machine is stopped or when a filled bag is to be released at a delayed moment.

14. An automatic weighing and bagging machine as claimed in claim 1 wherein there is further provided a first bag sensor to detect the presence of said first bag in its position to receive said weighed product.

15. An automatic weighing and bagging machine as claimed in claim 14 wherein said bag sensor is connected to said tipping mechanism to prevent operation of said tipping mechanism when the absence of said first bag is detected.

16. An automatic weighing and bagging machine as claimed in claim 10 wherein there is further provided a bag sensing shut-off valve in said air line, a first bag sensor connected to said bag sensing shut-off valve to prevent said discharge switch to signal said control valve in the absence of said first bag at a receiving position.

17. An automatic weighing machine comprising a weigh bucket having a pivotal attachment, a weigh scale coupled to said weigh bucket for weighing a product to be bagged, a tipping mechanism for displacing said bucket on said pivotal attachment for discharging said weighed product therein into the open mouth of a first bag to be filled, sensing means to detect the delivery of said weighed product to said bag, said tipping mechanism having a piston activated linkage having bucket engaging means releasably engageable with said bucket for causing said bucket pivotal displacement and to release said bucket for weighing said product therein, said bucket having an engageable element, said bucket engaging means being a releasably engageable guide member to engage and displace said engageable element in an arcuate path about said pivotal attachment to tip said bucket whereby said product therein will slide out at a discharge end and be directed in said first bag, said engageable element being a rear flange of said bucket, said guide member comprising two spaced apart fingers defining a gap therebetween, said rear flange extending in said gap intermediate said spaced apart fingers when said bucket is at a weighing position, said fingers being secured to an arcuate displaceable link arm to tip said bucket.

18. An automatic weighing and bagging machine for placing a weighed product in a first bag of a plurality of juxtaposed bags held in said machine, said bags each having an extended tab secured to a portion thereof, said tab extending above a mouth opening of said bag, said machine comprising retaining means for supporting said plurality of bags in juxtaposition, bag opening means for opening said mouth opening of said first bag, clamping means associated with said bag opening means for holding said bag in an open position by clamping said bag from opposed sides thereof, a weigh bucket for holding and weighing a product to be bagged, a weigh scale coupled to said weigh bucket for weighing said product to be bagged, discharge means for displacing said weighed product from said container weighing means to said open mouth of said first bag to place said weighed product in said first bag, sensing means to detect the delivery of said weighed product to said first bag, said discharge means being a tipping mechanism for displacing said bucket on a pivotal attachment for discharging said weighed product therein into said first bag, a discharge switch connected to a control valve to cause said bucket to move to its discharge position, said discharge switch being a pneumatic switch having an air line connected to said control valve, a first shut-off valve connected in said air line to prevent said discharge switch to signal said control valve if said weight of said product in said bucket is under a desired value, a bag sensing shut-off valve in said air line, a first bag sensor connected to said bag sensing shut-off valve to prevent said discharge switch to signal said control valve in the absence of said first bag at a receiving position, and actuating means for releasing said holding means and clamping means to cause said first bag with said weighed product to be released from said machine due to its own weight.

19. An automatic weighing and bagging machine as claimed in claim 1 or 18 wherein there is provided holding means for engaging at least a portion of said extended tab of said first bag, said bag opening means pulling a side wall portion of said first bag opposite to said engaged portion of said tab away from said engaged tab, said clamping means clamping said side wall portion to hold said bag in said open position.

* * * * *